US007861737B2

(12) United States Patent
Henaut et al.

(10) Patent No.: US 7,861,737 B2
(45) Date of Patent: Jan. 4, 2011

(54) METHOD OF OPTIMIZING HEAVY CRUDE TRANSPORTATION BY INCORPORATION UNDER PRESSURE OF DIMETHYL ETHER

(75) Inventors: Isabelle Henaut, Rueil-Malmaison (FR); Alain Forestiere, Vernaison (FR); Jean-Philippe Heraud, Lyons (FR); Jean-François Argillier, Rueil-Malmaison (FR)

(73) Assignee: IFP, Cedex (FR)

( * ) Notice: Subject to any disclaimer, the term of this patent is extended or adjusted under 35 U.S.C. 154(b) by 237 days.

(21) Appl. No.: 11/766,120

(22) Filed: Jun. 21, 2007

(65) Prior Publication Data

US 2007/0295642 A1 Dec. 27, 2007

(30) Foreign Application Priority Data

Jun. 27, 2006 (FR) ..... 06 05976

(51) Int. Cl.
*C10G 49/00* (2006.01)

(52) U.S. Cl. ..... 137/13; 137/14; 208/370

(58) Field of Classification Search ..... 208/46, 208/370; 137/13–14
See application file for complete search history.

(56) References Cited

U.S. PATENT DOCUMENTS

| | | | |
|---|---|---|---|
| 4,027,688 | A | 6/1977 | Gruber et al. |
| 4,753,261 | A | 6/1988 | Zagustin et al. |
| 5,110,447 | A | 5/1992 | MacWilliams et al. |

FOREIGN PATENT DOCUMENTS

| | | |
|---|---|---|
| CA | 913004 | * 10/1972 |
| FR | 2 852 666 | 9/2004 |
| JP | 2006-104294 | 4/2006 |

OTHER PUBLICATIONS

Bhide, S et al. (2003). Energy Fuels, 17(5), 1126-1132.*
FR 0605976, French Search Report, Feb. 26, 2007.
Database WPI Week 198929, Dewent Publications Ltd., London GB,; an 1989-212806 XP002422019 & SU 1 451 435 A (As Sibe Petrochem) Jan. 15, 1989.

* cited by examiner

*Primary Examiner*—Robert J Hill, Jr.
*Assistant Examiner*—Brian McCaig
(74) *Attorney, Agent, or Firm*—Antonelli, Terry, Stout & Kraus, LLP.

(57) ABSTRACT

Heavy crude transportation optimization method wherein at least one solvent is added to said crude. According to the method, a predetermined amount of dimethyl ether (DME) is added under pressure so as to adjust the viscosity of the crude.

18 Claims, No Drawings

METHOD OF OPTIMIZING HEAVY CRUDE TRANSPORTATION BY INCORPORATION UNDER PRESSURE OF DIMETHYL ETHER

FIELD OF THE INVENTION

The invention relates to the sphere of production of heavy crudes which notably have the drawback of too high a viscosity. The object of the method according to the invention is to reduce the pressure drop during heavy crude pipeline transportation by acting on the viscosity thereof.

Heavy oils are defined as crude oils whose API gravity is below 20. These oils, the world reserves of which are of the same order as for all the conventional oils, are characterized by a high asphaltene content and by a high viscosity that can reach up to a million centipoise at reservoir temperature. Their transportation by pipeline is therefore much more difficult than in the case of conventional crudes. Heavy crude pipeline transportation implies that the viscosity is sufficiently low considering the dimension of the transportation lines and the power of the pumping installations, selected in accordance with the economic optimum.

BACKGROUND OF THE INVENTION

There are various methods known to the man skilled in the art that allow heavy oil pipeline transportation. These methods are, for example, heating, dilution, aqueous emulsification, core annular flow, or partial crude refining on the production site before transportation.

Heating is an effective way of reducing notably the viscosity of heavy oils. However, depending on the characteristics of the crude to be transported, it may be necessary to bring the fluid to relatively high temperatures, sometimes above 100° C., to obtain a viscosity compatible with industrial plants. Furthermore, it is important to maintain the temperature of the fluid at this level all along the line, which implies thermal insulation of the lines and sometimes installation of heating units combined with the pumping installations.

Emulsification of crude in water is also used. In this technique, the crude is transported in form of fine droplets in a continuous phase mainly consisting of water. In order to guarantee emulsion stability all along the pipeline, it is necessary to add judiciously selected surfactants to the water. These surfactants must also simultaneously allow, in a simple manner, inversion of the emulsion upon arrival at the refinery and recovery of the anhydrous crude, and treatment of the polluted water.

Core annular flow consists in transporting the crude surrounded by a water film. This is the most effective method for reducing pressure drops, which are almost comparable to those obtained with water. This technique is for example described in U.S. Pat. No. 4,753,261. However, this method involves difficulties linked with the flow stability, fouling of the pipeline walls in the course of time and notably restarting difficulties in case of non-programmed production stop, which is why this transportation mode has not been used much up to now.

Another method that can be considered for bringing the viscosity of a crude to a value compatible with pipeline transportation is partial refining on the production site. An example is given in U.S. Pat. No. 5,110,447. This method requires considerable investments and high operating costs due to the increase in the number of visbreaking units on the site.

In order to reduce the viscosity of heavy oils, they are commonly diluted by means of solvents. The solvents used are hydrocarbon cuts such as condensates or naphtha. This method is based on the fact that the viscosity of heavy crudes is greatly reduced when adding a solvent of low viscosity. It is generally admitted that, in order to obtain a sufficient viscosity reduction to allow pipeline transportation of a heavy oil, the amount of light solvent to be added ranges between 10 and 50% by volume. When this method is used, it most often comprises a second pipeline allowing to recycle the solvent after distillation separation at the refinery. This method can be regarded as the most effective for heavy crude transportation. Despite considerable investment, it allows oil to be transported without particular risks, even in case of prolonged production stop. Furthermore, diluting the crude facilitates certain operations such as separation of the production water. However, the volume to be transported is increased, and the cost of the solvent and of its possible separation from the crude in order to recycle it is not insignificant.

One possible improvement to the dilution of heavy crudes consists in improving the method so as to obtain the viscosity required for pipeline transportation using a lower volume of solvent.

SUMMARY OF THE INVENTION

The present invention thus relates to a method of optimizing heavy crude transportation wherein at least one solvent is added to the crude. According to the invention, a predetermined amount of dimethyl ether (DME) is added under pressure.

The addition pressure can be at least about 4 bars.

The solvent can comprise naphtha.

The DME can be recovered by means of at least one fluidified crude expansion stage.

The DME can be recovered by means of at least one fluidified crude distillation stage.

The proportion by mass of DME can range between 1 and 25% of the crude.

The proportion by mass of DME can range between 4 and 10% of the crude.

The object of the present invention is to improve the method of diluting a heavy crude. It has been shown that the addition under pressure of DME (dimethyl ether) leads to a notable crude viscosity decrease. If a first solvent is used, the addition under pressure of DME shows a change in the solubility parameters of the solvent used, in particular a notable improvement in the dilution efficiency of the solvent considered. Furthermore, recovery of the DME upstream from the refinery is greatly facilitated by the very nature of the DME.

DETAILED DESCRIPTION

The present invention thus relates to a method of diluting heavy crudes under pressure. It has been shown that well-chosen pressure and temperature conditions allow incorporation of dimethyl ether to the crude and/or to a solvent used. A dilution improvement is thus observed. The present invention in fact allows not only to increase the polarity of the diluent, but also to greatly decrease the inherent viscosity thereof.

The following examples illustrate the invention without however limiting it to these embodiments.

Example 1

A heavy Venezuelan crude of density 8.5 API degrees has a viscosity of 940 Pa·s at 15° C. and 5 bars.

This crude is diluted in the proportion of 22.5% by mass with naphtha. The viscosity of the crude is then 0.525 Pa·s at 15° C. and 5 bars.

Example 2

The previous crude oil is diluted with naphtha in the proportion of 11.5% by weight. Liquid DME (dimethyl ether) is then added at 5 bars and 15° C. until a viscosity of 0.525 Pa·s is obtained. The required DME mass is measured. The dilution percentage is then calculated, it corresponds to 15% by mass of diluents, with a DME/naphtha mass ratio of 0.36.

Example 3

The addition of liquid DME is continued at the end of Example 2 until a viscosity of 0.04 Pa·s is obtained at 15° C. and 5 bars. The DME mass required to obtain this value is measured. The calculated dilution percentage corresponds to 23.4% by mass with a DME/naphtha mass ratio of 1.4. By way of comparison, a crude oil mixture is diluted with naphtha in the proportion of 23.4% by mass, the viscosity obtained is 0.34 Pa·s at 15° C. and 5 bars. The efficiency of the addition under pressure of DME is clearly visible.

Example 4

A Canadian crude oil has a viscosity of 205 Pa·s at 15° C. and 5 bars. This crude is diluted in the proportion of 22.5% by mass with naphtha. The viscosity of the crude then becomes 0.23 Pa·s at 15° C. and 5 bars.

Example 5

The Canadian crude used in Example 4 is diluted with naphtha in the proportion of 11.5% by mass. Liquid DME (dimethyl ether) is then introduced at 5 bars and 15° C. until a viscosity of 0.23 Pa·s is obtained. The required DME mass is measured and the calculated dilution percentage corresponds to 19.8% by mass, with a DME/naphtha mass ratio of 0.2. By way of comparison, a crude oil mixture is diluted with naphtha in the proportion of 19.8% by mass, the viscosity obtained is 0.41 Pa·s at 15° C. and 5 bars.

The previous examples were completed by carrying out tests at a higher ambient temperature: 25° C.

Example 1a

A heavy Venezuelan crude of density 8.5 API degrees has a viscosity of 200 Pa·s at 25° C. and 4 bars.

This crude is diluted in the proportion of 22.5% by mass with naphtha. The viscosity of the crude is then 0.265 Pa·s at 25° C. and 4 bars.

Example 2a

The previous crude oil is diluted with naphtha in the proportion of 11.5%. DME (dimethyl ether) in gaseous form is then added at 4 bars and 25° C. until a viscosity of 0.265 Pa·s is obtained. The required DME mass is measured. The dilution percentage is then calculated, it corresponds to 17% by mass, with a DME/naphtha mass ratio of 0.4.

Example 4a

A Canadian crude oil has a viscosity of 30 Pa·s at 25° C. and 4 bars. This crude is diluted in the proportion of 22.5% by mass with naphtha. The viscosity of the crude then becomes 0.168 Pa·s at 25° C. and 4 bars.

Example 5a

The aforementioned Canadian crude is diluted with naphtha in the proportion of 11.5%. Gaseous DME (dimethyl ether) is then introduced at 4 bars and 25° C. until a viscosity of 0.168 Pa·s is obtained. The required DME mass is measured. The calculated dilution percentage corresponds to 17% by mass, with a DME/naphtha mass ratio of 0.4.

The examples above clearly show the efficiency of DME used as the thinning agent for a crude coming directly from a production well, or first diluted with naphtha for example. The amounts of DME injected under pressure are determined according to the nature of the fluid to be fluidified, notably its initial viscosity, and the desired final viscosity for a given production situation.

The diluted crude having been transported to the inlet of the refining plant, the first stage comprises means, distillation means for example, for collecting the solvents, in particular the DME. A simple expansion allows the DME to be vaporized and recovered in gaseous form. This operational stage provides the whole process with a great economic advantage.

Dilution of the heavy crude can be carried out at the bottom of the production well, downstream from the wellhead at the surface, or in an intermediate transportation line.

The invention claimed is:

1. A method of optimizing heavy hydrocarbon crude transportation, comprising:

adding at least one solvent to said crude, adding dimethyl ether (DME) under pressure in a mass proportion between 13.65 and 25% based on the heavy hydrocarbon crude.

2. A method as claimed in claim 1, wherein said pressure is at least about 4 bars.

3. A method as claimed in claim 1, wherein said solvent comprises naphtha.

4. A method as claimed in claim 1, wherein the DME is recovered by means of at least one fluidified crude expansion stage.

5. A method as claimed in claim 1, wherein the DME is recovered by means of at least one fluidified crude distillation stage.

6. A method of optimizing heavy hydrocarbon crude transportation, comprising the steps of:

providing a heavy hydrocarbon crude;

adding at least one solvent to the heavy hydrocarbon crude and adding dimethyl ether (DME) under pressure in an amount between 13.65 and 25% by mass based on the crude to form a diluted crude; and transporting the diluted crude.

7. A method as claimed in claim 6, wherein the step of adding at least one solvent to the heavy hydrocarbon crude and adding a predetermined amount of dimethyl ether (DME) under pressure to the heavy hydrocarbon crude to form a diluted crude comprises adding at least one solvent to the heavy hydrocarbon crude to form a diluted crude and then adding a predetermined amount of dimethyl ether (DME) under pressure to the diluted crude to provide crude having a desired viscosity.

8. A method as claimed in claim 6, wherein the pressure is at least about 4 bars.

9. A method as claimed in claim 6, wherein the at least one solvent comprises naphtha.

10. A method as claimed in claim 6, wherein the step of adding at least one solvent to the heavy hydrocarbon crude and adding a predetermined amount of dimethyl ether (DME) under pressure to the heavy hydrocarbon crude to form a diluted crude is carried out at the bottom of a production well.

11. A method as claimed in claim 6, wherein the step of adding at least one solvent to the heavy hydrocarbon crude and adding a predetermined amount of dimethyl ether (DME) under pressure to the heavy hydrocarbon crude to form a diluted crude is carried out downstream of a wellhead at a surface.

12. A method as claimed in claim 6, wherein the step of adding at least one solvent to the heavy hydrocarbon crude and adding a predetermined amount of dimethyl ether (DME) under pressure to the heavy hydrocarbon crude to form a diluted crude is carried out in a transportation line.

13. A method as claimed in claim 6, wherein the step of transporting the diluted crude transports the crude having the desired viscosity to a refining plant.

14. A method as claimed in claim 13, further comprising, at the refining plant, recovering the DME by at least one fluidified crude expansion stage.

15. A method as claimed in claim 13, further comprising, at the refining plant, recovering the DME by at least one fluidified crude distillation stage.

16. A method as claimed in claim 6, further comprising, after transporting the diluted crude, recovering the DME by at least one fluidified crude expansion stage.

17. A method as claimed in claim 6, further comprising, after transporting the diluted crude, recovering the DME by at least one fluidified crude distillation stage.

18. A method as claimed in claim 6, wherein the at least one solvent and the DME are added to have a mass proportion ranging from 15 to 23.4% of the crude.

* * * * *